US007673876B1

(12) United States Patent
DeGruchy

(10) Patent No.: US 7,673,876 B1
(45) Date of Patent: Mar. 9, 2010

(54) VELOCITY MATCHING CALIBRATION METHOD FOR MULTIPLE INDEPENDENTLY DRIVEN SHEET TRANSPORT DEVICES

(75) Inventor: Paul DeGruchy, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/363,819

(22) Filed: Feb. 2, 2009

(51) Int. Cl.
*B65H 5/00* (2006.01)
*B65H 5/34* (2006.01)

(52) U.S. Cl. ..... 271/264; 271/270

(58) Field of Classification Search ..... 271/264, 271/270; 347/104; 399/16
See application file for complete search history.

(56) References Cited

U.S. PATENT DOCUMENTS

| | | | | |
|---|---|---|---|---|
| 4,687,925 | A | 8/1987 | Huggins | |
| 5,120,977 | A * | 6/1992 | Dragon et al. | 250/559.37 |
| 5,241,525 | A | 8/1993 | Taylor | |
| 5,836,580 | A * | 11/1998 | Hansen et al. | 271/9.13 |
| 5,838,338 | A * | 11/1998 | Olson | 347/8 |
| 7,457,557 | B2 | 11/2008 | Roof et al. | |
| 2003/0108369 | A1 | 6/2003 | Kuo et al. | |
| 2004/0065994 | A1 | 4/2004 | Halvonik et al. | |
| 2005/0156374 | A1 * | 7/2005 | Siegel et al. | 271/258.01 |
| 2006/0222378 | A1 | 10/2006 | Julien | |
| 2007/0222142 | A1 * | 9/2007 | Owen | 271/256 |
| 2008/0150218 | A1 * | 6/2008 | Clark et al. | 271/10.02 |
| 2008/0258382 | A1 | 10/2008 | deJong et al. | |
| 2008/0260445 | A1 | 10/2008 | Costanza et al. | |

FOREIGN PATENT DOCUMENTS

| | | | |
|---|---|---|---|
| EP | 1054302 | A2 | 11/2000 |

OTHER PUBLICATIONS http://www.patentstorm.us/patents/5150115/description, 1992.
http://www.alegralab.org/lessons/lesson.aspx?file=Trigonometry_TrigAngLinVelocity, 2003-2009.
http://en.wikipedia.org/wiki/Servomechanism.

* cited by examiner

*Primary Examiner*—David H Bollinger
(74) *Attorney, Agent, or Firm*—Gibb I.P. Law Firm, LLC

(57) ABSTRACT

Disclosed are method embodiments that incorporate calibration and printing operations to be used with a printing device. The printing device contains a sheet transport path with multiple adjacent sheet transport devices, each having at least one independently controlled drive roller. Each preceding sheet transport device feeds a sheet to a following sheet transport device along the path in succession. Two or more adjacent sheet transport devices are positioned to simultaneously engage the sheet as it is being transported along the path. The calibration operation is used to determine the particular drive roller angular velocity that should be used by each sheet transport device to compensate for drive roller contention during the printing operation and, thereby to ensure that the linear velocity of the sheet essentially remains constant as it is transported across each adjacent transport throughout the printing operation.

5 Claims, 9 Drawing Sheets

VELOCITY MATCHING CALIBRATION METHOD FOR MULTIPLE INDEPENDENTLY DRIVEN SHEET TRANSPORT DEVICES

BACKGROUND AND SUMMARY

Embodiments herein generally relate to printing devices and, more particularly, to a velocity matching calibration method for multiple sheet transport devices within a sheet transport path of a printing device.

Printing devices typically incorporate multiple independently driven sheet transport devices along a sheet transport path. Specifically, such sheet transport devices can include, but are not limited to, electrostatic transport belts, nip apparatuses, registration systems, fusers, etc., each having a servo-controlled drive roller. With such independently driven sheet transport devices, velocity matching can become critical in order to avoid errors (e.g., registration errors, image on image transfer errors, etc.), particularly when a transported sheet (e.g., a transported sheet of paper) spans across and is simultaneously engaged by multiple sheet transport devices. Current drive schemes try to minimize these errors by using, for each sheet transport device, a servomechanism with a very tight tolerance to accurately control power supplied to the motor which rotates the drive roller and, thereby to accurately control the linear velocity of the sheet being transported. Unfortunately, when a single sheet is simultaneously engaged by two independently driven adjacent sheet transport devices, any velocity discrepancy between the two devices will cause contention between the servomechanisms. During such contention, the servomechanisms for the sheet transport devices essentially "fight" for velocity control, which can cause a mismatch between the velocity of the leading edge of the sheet and the trailing edge as they pass a given point. For example, consider a sheet being transported along a path between a preceding sheet transport device and a following sheet transport device. When the servomechanisms of the sheet transport devices are in contention, the sheet, as it passes a point along the path, will have a certain velocity equal to either that of a dominating transport if slippage occurs in the other contending transport, a differential velocity if sheet buckling occurs, or some velocity equilibrium between the contending transports. When the sheet is finally output from the preceding sheet transport device such that the servomechanisms of the two sheet transport devices are no longer in contention, the velocity of the sheet could momentarily spike up or down from accumulated servo positional error. Such velocity variations can result in the same errors that the servomechanisms were designed to avoid (e.g., registration errors, image on image transfer errors, etc.).

In view of the foregoing, disclosed herein are embodiments of a method that incorporates calibration and printing operations to be used with a printing device. The printing device contains a sheet transport path with multiple adjacent sheet transport devices (e.g., electrostatic sheet transport belts, nip roller apparatuses, registration systems, fusers, etc.), each having at least one independently controlled drive roller. Each preceding sheet transport device feeds a sheet to a following sheet transport device along the path in succession. Furthermore, two or more adjacent sheet transport devices are positioned to simultaneously engage the sheet as it is being transported along the path. The calibration operation is used to determine the particular drive roller angular velocity that should be used by each sheet transport device to compensate for drive roller contention during the printing operation and, thereby to ensure that the linear velocity of the sheet essentially remains constant as it is transported across each adjacent transport throughout the printing operation.

More particularly, one embodiment of the method comprises performing a calibration operation for adjacent sheet transport devices within a sheet transport path of a printing device and also performing at least one printing operation using the printing device.

This calibration operation comprises transporting a test sheet along the path. When the test sheet is simultaneously transported by contacting both a first sheet transport device and a second sheet transport device that is positioned adjacent to the first sheet transport device in the path (i.e., when the sheet is simultaneously engaged by or acted upon by both the first and second sheet transport devices in order to move the sheet towards the end of the path), then a constant power mode (i.e., a torque assist mode) is used to rotate a first drive roller of the first sheet transport device. Additionally, a constant velocity mode is used to rotate a second drive roller of the second sheet transport device at a predetermined angular velocity. This predetermined angular velocity at which the second drive roller is set is determined prior to the calibration operation (e.g., by a user or by default based on a desired sheet velocity). As a function of these different modes, the second sheet transport device alone controls the linear velocity of the sheet and drive roller contention does not occur. As the first drive roller is rotated during the constant power mode, its actual angular velocity can be determined. The determined angular velocity can subsequently be used during the printing operation to compensate for drive contention.

Once the calibration operation is completed, one or more printing operation can be performed. Each printing operation comprises transporting a print sheet along the path. When the print sheet is transported by both the first sheet transport device and the second sheet transport device, then the constant velocity mode is used to rotate the first drive roller at the angular velocity that was determined for that first drive roller during the calibration operation. Additionally, the constant velocity mode is again used to rotate the second drive roller at the predetermined angular velocity. As a result of the calibration operation, drive contention is compensated for and the linear velocity of the print sheet used in the printing operation will essentially remain constant across the adjacent transport devices.

In another embodiment, the calibrated angular velocity used during the printing operation is a mean angular velocity based on multiple calibration passes rather than a single calibration pass in order to compensate for AC errors (i.e., errors due to belt thickness variations or the like, which are substantially consistent between belt revolutions). Specifically, this embodiment similarly comprises performing a calibration operation for adjacent sheet transport devices within a sheet transport path of a printing device and also performing at least one printing operation using the printing device.

The calibration operation comprises transporting multiple test sheets in succession along the path. Then, for each test sheet, the following calibration processes are performed. When the test sheet is transported by both a first sheet transport device and a second sheet transport device adjacent to the first sheet transport device in the path (i.e., when the sheet is simultaneously engaged by or acted upon by both the first and second sheet transport devices in order to move the sheet towards the end of the path), then a constant power mode is used to rotate a first drive roller of the first sheet transport device. Additionally, a constant velocity mode is used to rotate a second drive roller of the second sheet transport device at a predetermined angular velocity. This predetermined angular velocity at which the second drive roller is set is determined prior to the calibration operation (e.g., by a user or by default based on a desired sheet velocity). As a function of these different modes, the second sheet transport device alone controls the linear velocity of the sheet and drive roller contention does not occur. Then, as the first drive roller is rotated, its actual angular velocity can be determined. This process is repeated with each of the multiple test sheets. Then, using the multiple angular velocities determined with each calibration pass, a mean angular velocity is determined. The determined mean angular velocity can subsequently be used during the printing operation to compensate for drive contention.

Once the calibration operation is completed, one or more printing operations can be performed. Each printing operation comprises transporting a print sheet along the path. When the sheets are transported by both the first sheet transport device and the second sheet transport device, then the constant velocity mode is used to rotate the first drive roller at the mean angular velocity that was determined for the first drive roller during the calibration operation. Additionally, the constant velocity mode is again used to rotate the second drive roller at the predetermined angular velocity. As a result of the calibration operation, drive contention is compensated for and the linear velocity of the print sheet used in the printing operation will essentially remain constant across the adjacent transport devices.

In another embodiment, the method takes into account a situation where the printing device comprises three or more adjacent sheet transport devices within the sheet transport path and where the sheet transport devices are positioned in series such that sheets moving through the path may be transported by two of the sheet transport devices at a time. Specifically, this embodiment comprises performing a sequential calibration operation for at least three adjacent sheet transport devices within a sheet transport path of a printing device and also performing at least one printing operation using the printing device.

The sequential calibration operation comprises transporting at least one test sheet along the path. Then, each pair of the adjacent transport devices in the path is separately and sequentially calibrated, in either a first order beginning from the end of the path or a second order beginning from the start of the path. It should be understood that the pairs of transport devices sequentially overlap such that they all contain a transport device from at least one immediately adjacent pair During calibration, when a test sheet is transported by both a first sheet transport device and by a second sheet transport device that is adjacent to the first sheet transport device in a given pair (i.e., when the sheet is simultaneously engaged by or acted upon by both transport devices in a given pair in order to move the sheet towards the end of the path), then a constant power mode is used to rotate a first drive roller of the first sheet transport device. Additionally, a constant velocity mode is used to rotate a second drive roller of the second sheet transport device at a predetermined angular velocity. It should be noted the relative position of the "first sheet transport device" and the "second sheet transport device" within the path for purposes of performing the calibration operation varies depending upon whether the calibration operation is being perform in the first order or in the second order. Specifically, when the calibration operation is performed in the first order (i.e., beginning from the end of the path), then the second sheet transport device follows the first sheet transport device within the path. Contrarily, when the calibration operation is performed in the second order (i.e., beginning from the start of the path), then the second sheet transport device precedes the first sheet transport device within the path.

As a function of these different modes, the second sheet transport device in the given pair alone controls the linear velocity of the sheet and drive roller contention does not occur. Then, as the first drive roller in the given pair is rotated, its actual angular velocity is determined. Optionally, rather than determining the angular velocity based on one calibration pass, multiple calibration passes can be performed and a mean angular velocity for the first drive roller of each pair can be determined. The determined angular velocity (or determined mean angular velocity) can subsequently be used during the printing operation to compensate for drive contention.

As mentioned above, this process is repeated for each pair in either the first order or the second order. It should be noted that, during calibration of the first pair in the order, the predetermined angular velocity at which the second drive roller is set is determined prior to the calibration operation (e.g., by a user or by default based on a desired sheet velocity). It should also be noted that, as mentioned above, the pairs of transport devices sequentially overlap such that they all contain a transport device from at least one immediately adjacent pair. Thus, with each subsequently calibrated pair, the second drive roller is actually the first drive roller of an immediately adjacent and previously calibrated pair and the predetermined angular velocity that should be used for the second drive roller is the previously calibrated angular velocity (i.e., is that angular velocity determined for the first drive roller during calibration of the immediately adjacent and previously calibrated pair).

Once the calibration operation is completed, one or more printing operations can be performed. Each printing operation comprises transporting a print sheet along the path. When the print sheet is transported along a given pair, then the constant velocity mode is used to rotate the first drive roller at the angular velocity (or mean angular velocity) that was determined for the first drive roller during the calibration operation. Additionally, the constant velocity mode is again used to rotate the second drive roller at the predetermined angular velocity. As a result of the calibration operation, drive contention is compensated for and the linear velocity of the print sheet used in the printing operation will essentially remain constant across the adjacent transport devices.

Another embodiment of the method takes into account a situation where the printing device comprises three or more adjacent sheet transport devices within the sheet transport path and where the sheet transport devices are positioned in series such that sheets moving through the path may be transported by a set of three or more of the sheet transport devices at a time. As with the previously described embodiments, this embodiment comprises performing a calibration operation for the adjacent sheet transport devices within a sheet transport path of a printing device and also performing at least one printing operation using the printing device.

The calibration operation comprises transporting at least one sheet along the path. Then, each set of the adjacent sheet transport devices, which will simultaneously engage a sheet being transported along the sheet transport path, is separately and sequentially calibrated in either a first order beginning from the end of the path or a second order beginning from the start of the path. It should be understood that the sets of transport devices sequentially overlap such that they all contain transport devices from at least one immediately adjacent set.

During calibration, when a test sheet is transported by all sheet transport devices in a given set (i.e., when the sheet is simultaneously engaged by or acted upon by all transport devices in a given set in order to move the sheet towards the end of the path), a constant velocity mode is used to rotate a single drive roller of a single transport device in the given set at a predetermined angular velocity. Additionally, a constant power mode is used to rotate any other drive rollers of any other transport devices in the given set. It should be noted the relative position of the "single transport device" and the "any other transport devices" within the path for purposes of performing the calibration operation varies depending upon whether the calibration operation is being perform in the first order or in the second order. Specifically, when the calibration operation is performed in the first order the single transport device follows, within the path, any other transport devices of a set. Contrarily, when the calibration operation is performed in the second order the single transport device precedes, within the path, any other transport devices of a set.

As a function of these different modes, the single transport device in the given set alone controls the linear velocity of the sheet and drive roller contention does not occur. Then, as the other drive rollers are rotated, their corresponding angular velocities are determined. Optionally, rather than determining the corresponding angular velocities based on one calibration pass, multiple calibration passes can be performed and corresponding mean angular velocities for these other drive rollers within each set can be determined.

As mentioned above, this process is repeated for each set in the selected order. It should be noted that, during calibration of the first set in the order, the predetermined angular velocity at which the single drive roller is set is determined prior to the calibration operation (e.g., by a user or by default based on a desired sheet velocity). It should also be noted that, as mentioned above, the sets of transport devices sequentially overlap such that they all contain transport devices from at least one immediately adjacent set. Thus, with each subsequently calibrated set, the predetermined angular velocity that should be used for the single drive roller is determined during calibration of the immediately adjacent and previously calibrated set.

Once the calibration operation is completed, one or more printing operations can be performed. Each printing operation comprises transporting a print sheet along the path. When the print sheet is transported along each given set, the constant velocity mode is used to rotate the single drive roller in that given set at the predetermined angular velocity. Additionally, the constant velocity mode is used to rotate any other drive rollers from any other sheet transport devices in that given set at their corresponding angular velocity, as determined during the calibration operation. As a result of the calibration operation, drive contention is compensated for and the linear velocity of the print sheet used in the printing operation will essentially remain constant across the adjacent transport devices. Furthermore, as discussed above, using corresponding mean angular velocities determined based on multiple calibration passes will compensate for (i.e., essentially zero out) AC errors.

In each of the above-described method embodiments, it should be understood that the constant power mode (i.e., the torque assist mode) and constant velocity mode are different modes by which actuators (e.g., servo drivers of servomechanisms) control the motors (e.g., servo motors) for the drive rollers and, thereby control the drive rollers of the different sheet transport devices. For example, in the constant power mode a constant level of power is supplied to a specified motor of a specified drive roller in order to approximately achieve a pre-set angular velocity. Alternatively, in the constant velocity mode an actual angular velocity of a specified drive roller is continuously or periodically determined and, based on the actual angular velocity, the level of power supplied to the specified motor of the specified drive roller is adjusted in order to maintain the specified driver roller at a pre-set angular velocity.

Also disclosed herein are embodiments of a computer program product comprising a computer usable medium having computer useable program code embodied therewith. This computer usable program code can be configured to perform the above described method embodiments.

These and other features are described in, or are apparent from, the following detailed description.

BRIEF DESCRIPTION OF THE DRAWINGS

Various exemplary embodiments of systems and methods are described in detail below, with reference to the attached drawing figures, in which.

DETAILED DESCRIPTION

The embodiments and the various features and advantageous details thereof are explained more fully with reference to the non-limiting embodiments that are illustrated in the accompanying drawings and detailed in the following description.

Printing devices typically incorporate multiple independently driven sheet transport devices along a sheet transport path. For example, see the simplified view of single color direct to paper printing device illustrated in FIG. 7 or the similar printing device disclosed and discussed in detail in U.S. Pat. No. 7,457,557 (issued on Nov. 25, 2008 and incorporated herein by reference), which each have multiple sheet transport devices. See also the multi-color direct to paper printing device having multiple color modules of FIG. 8 or the similar printing device disclosed and discussed in detail in U.S. Patent Application Publication No. 2006/0222378 (published on Oct. 5, 2006 and incorporated herein by reference), which each also have multiple sheet transport devices.

Figure 9:
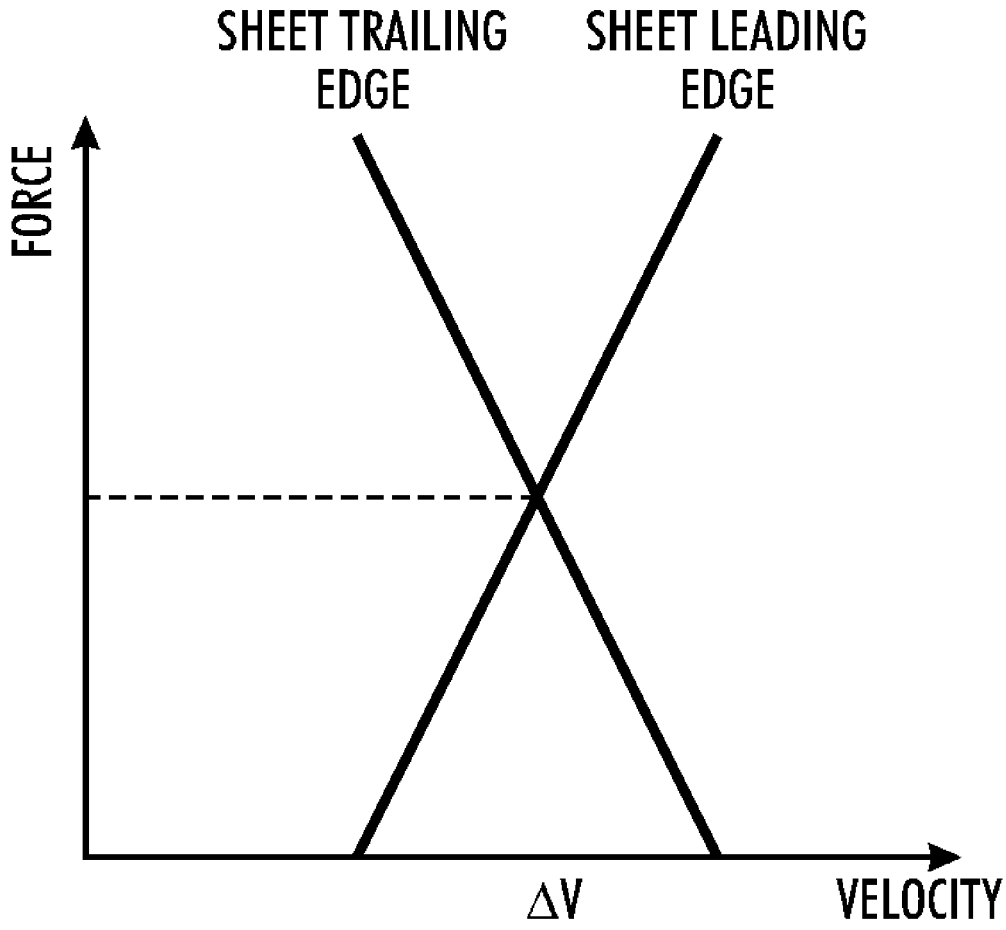
FIG. 9 is a graph illustrating mismatched sheet leading edge and trailing edge velocity as a function of contention between independently driven sheet transport devices.

Specifically, sheet transport devices incorporated into printing device can include, but are not limited to, electrostatic transport belts, nip apparatuses, registration systems, fusers, etc., each having a servo-controlled drive roller. With such independently driven sheet transport devices, velocity matching can become critical in order to avoid errors (e.g., registration errors, image on image transfer errors, etc.), particularly when a transported sheet (e.g., a transported sheet of paper) spans across and is simultaneously engaged by multiple sheet transport devices. Current drive schemes try to minimize these errors by using, for each sheet transport device, a servomechanism with a very tight tolerance to accurately control power supplied to the motor which rotates the drive roller and, thereby to accurately control the linear velocity of the sheet being transported. Unfortunately, when a single sheet is simultaneously engaged by two independently driven adjacent sheet transport devices, any velocity discrepancy between the two devices will cause contention between the servomechanisms. During such contention, the servomechanisms for the sheet transport devices essentially "fight" for velocity control, which can cause a mismatch between the velocity of the sheets as they pass a given point. For example, consider a sheet being transported along a path between a preceding sheet transport device and a following sheet transport device. When the servomechanisms of the sheet transport devices are in contention, of the sheet, as it passes a point along the path, will have a certain velocity equal to either that of a dominating transport if slippage occurs in the other contending transport, a differential velocity if sheet buckling occurs, or some velocity equilibrium between the contending transports. When the sheet is finally output from the preceding sheet transport device such that the servomechanisms of the two sheet transport devices are no longer in contention, the velocity of the sheet could momentarily spike up or down from accumulated servo positional error. As a result of the servomechanisms of the sheet transport devices essentially "fighting" for velocity control, velocity mismatch can occur from the leading edge of the sheet to the trailing edge as they pass a given point, as illustrated in the graph of FIG. 9. Such velocity variations can result in the same errors that the servomechanisms were designed to avoid (e.g., registration errors, image on image transfer errors, etc.).

Prior art drive schemes try to minimize these errors by using, for each sheet transport device, a servomechanism with a very tight tolerance to accurately control power supplied to the motor which rotates the drive roller and, thereby to accurately control the linear velocity of the sheet being transported. For example, one technique for avoiding such driver contention caused errors is to isolate the transport devices using vacuum transports between the devices so that even a large sheet can not be engaged simultaneously by multiple transports. This solution is, however, associated with high area costs. Another technique for avoiding such drive contention caused errors is to intentionally cause sheet buckle formation between transport belts to provide for some velocity buffer decoupling. However, accurately determining the necessary buckle size and forming the buckle can be difficult.

In view of the foregoing, disclosed herein are embodiments of a method that incorporates calibration and printing operations to be used with a printing device that contains a sheet transport path with multiple adjacent sheet transport devices (e.g., electrostatic sheet transport belts, nip roller apparatuses, registration systems, fusers, etc.), each having at least one independently controlled drive roller. Each preceding sheet transport device feeds a sheet to a following sheet transport device along the path in succession. Two or more adjacent sheet transport devices are positioned to simultaneously engage the sheet as it is being transported along the path. Those skilled in the art will recognize that angular velocity $\omega$ of a drive roller is equal to the ratio of the changing angle $\theta$ of a point on the surface of the drive roller over time (i.e., $\omega=\theta/t$), where the angle $\theta$ is measured in rotations, degrees or radians. In the absence of additional forces, such as drive contention, acting on a sheet being moved by the drive roller and causing, for example, sheet slipping, the linear velocity v of the sheet or rather of a particular point on the sheet (e.g., the leading edge or trailing edge) will be equal to the angular velocity $\omega$ times the radius r of the drive roller (i.e., $v=\omega r$). Thus, the calibration operation of the present embodiments is used to determine the particular drive roller angular velocity $\omega$ that should be used by each sheet transport device to compensate for drive roller contention during the printing operation and, thereby to ensure that the linear velocity v of the sheet essentially remains constant across each of the transport devices throughout the printing operation.

Referring to the flow diagram of FIG. 1 in combination with FIG. 2, one embodiment of the method considers the case of a printing device 200 that is similar to the printing device shown in FIG. 8 (see detailed discussion regarding the structure and operation of the device of FIG. 8 below). However, in this embodiment only two individually controlled adjacent sheet transport devices 201*a* and 201*b* are positioned such that they may simultaneous engage a sheet 225 being transported along the path 240, thereby causing drive roller contention. This embodiment comprises performing a calibration operation 100 for the adjacent sheet transport devices 201*a-b* within the sheet transport path 240 of the printing device 200 and also performing at least one printing operation 150 using the printing device 200.

The calibration operation (100) comprises transporting a test sheet (e.g., see sheet 225) along the path 240 (102). When the test sheet 225 is transported by both the first sheet transport device 201*a* and also by the second sheet transport device 201*b* that is positioned adjacent to the first sheet transport device 201*a* in the path 240 (e.g., as determined by sheet position sensors 229*a* and 229*b*) (i.e., when the sheet is simultaneously engaged by or acted upon by both the first and second sheet transport devices 201*a-b* to move the sheet towards the end 242 of the path 240), then a constant power mode (i.e., a torque assist mode) is used to rotate a first drive roller 244*a* and, thereby the belt 243*a* of the first sheet transport device 201*a* (104). Additionally, a constant velocity mode is used to rotate a second drive roller 244*b* and, thereby the belt 243*b* of the second sheet transport device 201*b* at a predetermined angular velocity $\omega_2$ (106). This predetermined angular velocity $\omega_2$ at which the second drive roller 244*b* is set is determined prior to the calibration operation (e.g., by a user or by default based on a desired linear velocity for the sheet).

Mode adjustment can be accomplished through the use of a conventional controller or electronic control subsystem (ESS) (e.g., as discussed in U.S. Pat. No. 7,457,557 incorporated by reference above), which preferably comprises a programmable, self-contained, dedicated mini-computer having a central processor unit (CPU), electronic storage, etc., which is located onboard the printing device 200 and which functions as the main control system for the components and other subsystems of printing device 200, including the control system for any discrete servomechanisms for independently driving the various sheet transport devices. As a function of these different modes, the second sheet transport device 201*b* alone controls the linear velocity of the sheet 225, during calibration, and drive roller contention does not occur. As the first drive roller 244*a* is rotated, its actual angular velocity $\omega_1$ can be determined (108). Angular velocity $\omega_1$ can be determined using conventional processing techniques. For example, each drive roller 244*a* and 244*b* can be configured with a motion encoder (not shown), which produces an electronic signal whose frequency is proportional to the angular velocity of the roller being measured. The determined angular velocity $\omega_1$ can subsequently be used during the printing operation (at process 150) to compensate for drive contention.

Once the calibration operation is completed, one or more printing operations can be performed (150). Each printing operation comprises transporting a print sheet 225 along the path 240 (152). When the print sheet 225 is being transported by both the first sheet transport device 201*a* and the second sheet transport device 201*b* (e.g., as determined by sheet position sensors 229*a* and 229*b*), then the constant velocity mode is used to rotate the first drive roller 244*a* of the first sheet transport device 201*a* at the angular velocity $\omega_1$ that was determined for that first drive roller 244*a* during the calibration operation (154). Additionally, the constant velocity mode is again used to rotate the second drive roller 244*b* of the second sheet transport device 201*b* at the predetermined angular velocity $\omega_2$ (156). As a result of the calibration operation, drive contention is compensated for and the linear velocity v from the leading edge 227 of each sheet 225 to the trailing edge 228 of each sheet 225 will remain essentially constant during the printing operation across adjacent sheet transport devices.

Figure 1:
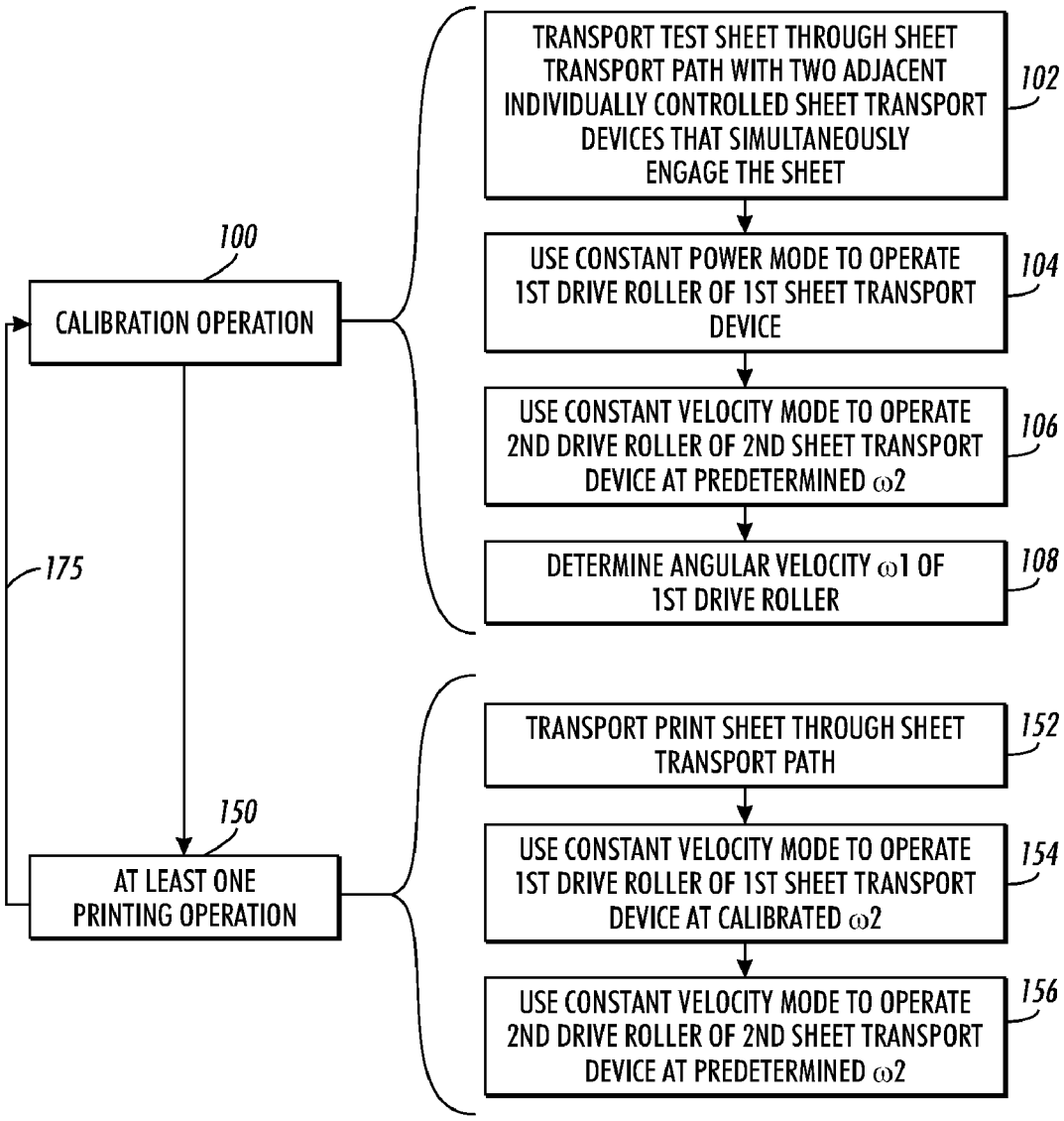
FIG. 1 is a flow diagram illustrating a method embodiment.
Figure 2:
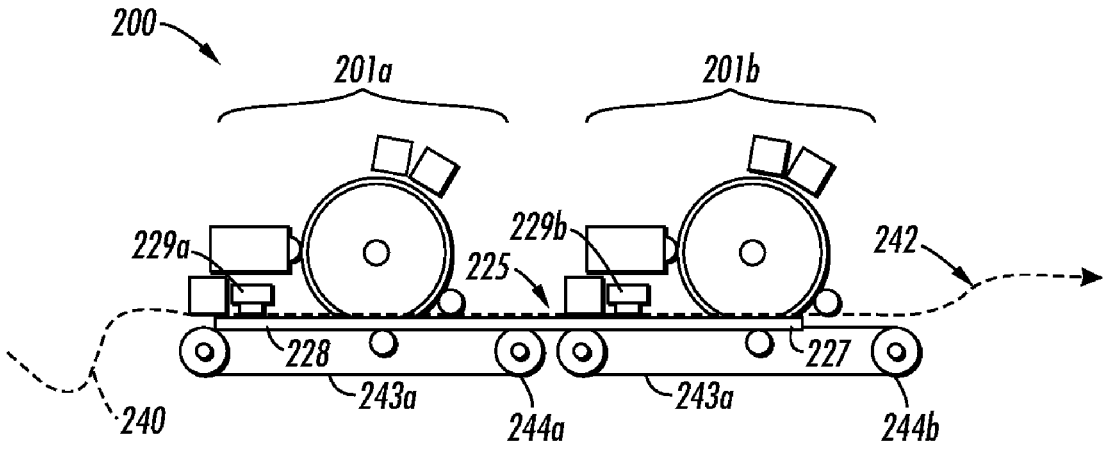
FIG. 2 is a schematic diagram illustrating an exemplary printing device.
Figure 3:
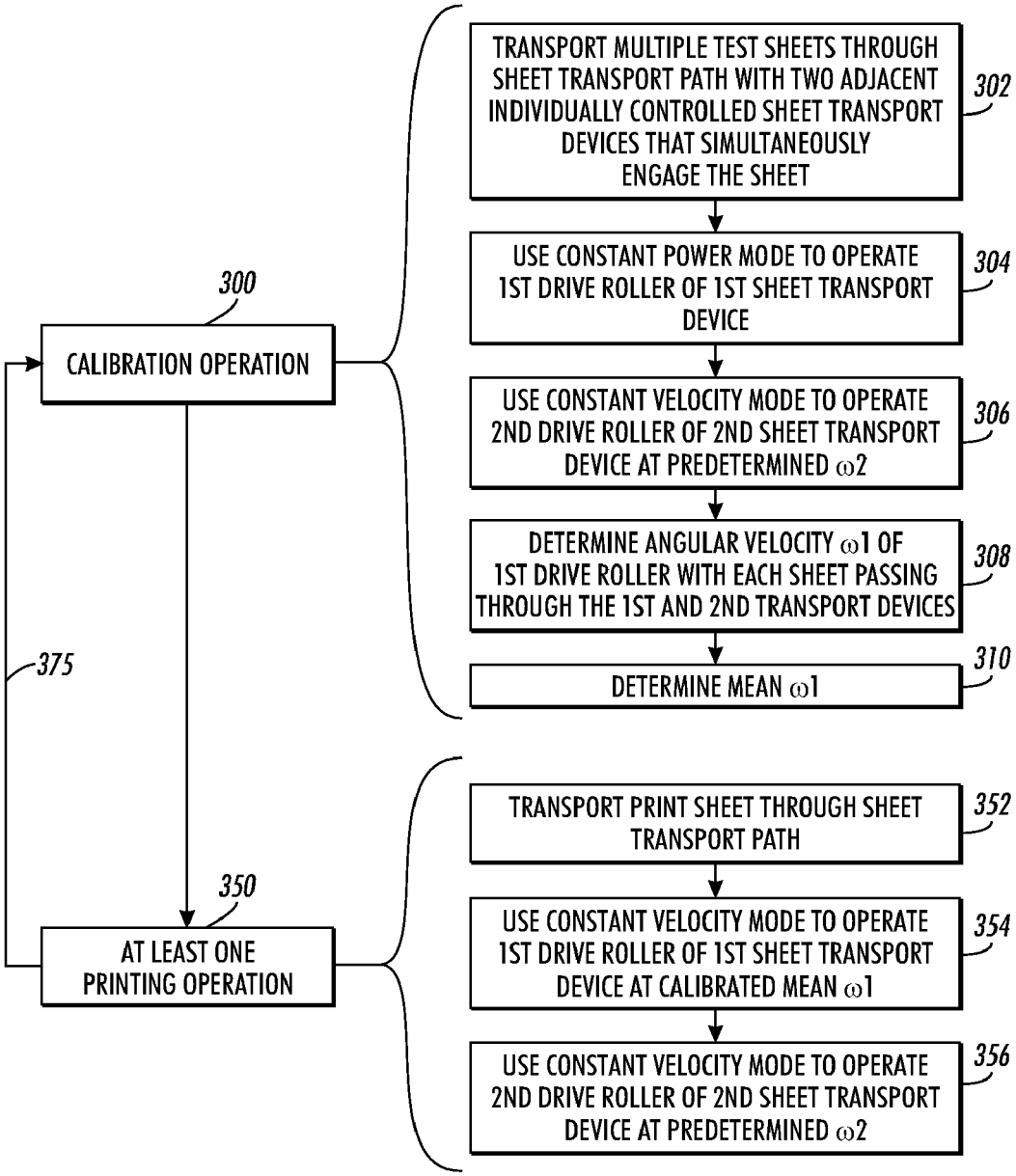
FIG. 3 is a flow diagram illustrating a method embodiment.

In another embodiment, the calibrated angular velocity used during the printing operation is a mean angular velocity (i.e., mean $\omega_1$) based on multiple calibration passes rather than a single calibration pass, as shown in FIG. 1, in order to compensate for AC errors (i.e., errors due to belt thickness variations or the like, which are substantially consistent between belt revolutions). Specifically, referring to the flow diagram of FIG. 3 in combination with FIG. 2, this embodiment similarly comprises performing a calibration operation 300 for adjacent sheet transport devices 201*a-b* within a sheet transport path 240 of a printing device 200 and also performing at least one printing operation 350 using the printing device 200.

The calibration operation (300) comprises transporting multiple test sheets 225 in succession along the path 240 (302). Then, for each test sheet, the following calibration processes are performed. When the test sheet is transported by a first sheet transport device 201*a* and by a second sheet transport device 201*b* adjacent to the first sheet transport device 201*a* in the path 240 (e.g., as determined by sheet position sensors 229*a* and 229*b*) (i.e., when the sheet is simultaneously engaged by or acted upon by both the first and second sheet transport devices 201*a-b* in order to move the sheet towards the end 242 of the path 240), then a constant power mode is used to rotate a first drive roller 244*a* of the first sheet transport device 201*a* (304). Additionally, a constant velocity mode is used to rotate a second drive roller 244*b* of the second sheet transport device 201*b* at a predetermined angular velocity $\omega_2$. This predetermined angular velocity $\omega_2$ at which the second drive roller 244*b* is set is determined prior to the calibration operation (e.g., by a user or by default based on a desired linear velocity for the sheet).

Mode adjustment can be accomplished through the use of a conventional controller or electronic control subsystem (ESS) (e.g., as discussed in U.S. Pat. No. 7,457,557 incorporated by reference above), which preferably comprises a programmable, self-contained, dedicated mini-computer having a central processor unit (CPU), electronic storage, etc., which is located onboard the printing device 200 and which functions as the main control system for the components and other subsystems of printing device 200, including the control system for any discrete servomechanisms for independently driving the various sheet transport devices. As a function of these different modes, the second sheet transport device 201*a* alone controls the linear velocity v of the sheet 225 and drive roller contention does not occur.

Then, as the first drive roller 244*a* is rotated, its actual angular velocity $\omega_1$ can be determined (308). Angular velocity is determined using conventional processing techniques. For example, each drive roller 244*a* and 244*b* can be configured with a motion encoder (not shown), which produces an electronic signal whose frequency is proportional to the angular velocity of the roller being measured. This process is repeated with each of the multiple test sheets. Then, using the multiple angular velocities $\omega_1$ determined with each calibration pass, a mean angular velocity (mean $\omega_1$) is determined (310). The determined mean angular velocity (mean $\omega_1$) can subsequently be used during the printing operation to compensate for drive contention.

Once the calibration operation is completed, one or more printing operations can be performed (350). Each printing operation comprises transporting a print sheet 225 along the path 240 (352). When the print sheet 225 is being transported by the first sheet transport device 201*a* and the second sheet transport device 201*b* (e.g., as determined by sheet position sensors 229*a* and 229*b*), then the constant velocity mode is used to rotate the first drive roller 244*a* at the mean angular velocity (mean $\omega_1$) that was determined for the first drive roller 244*a* during the calibration operation (354). Additionally, the constant velocity mode is again used to rotate the second drive roller 244*b* at the predetermined angular velocity $\omega_2$. As a result of the calibration operation, drive contention is compensated for and the linear velocity v from the leading edge 227 of the sheet 225 to the trailing edge 228 of that sheet 225 will remain essentially constant during the printing operation across adjacent sheet transport devices. Furthermore, as discussed above, using a mean angular velocity (mean $\omega_1$) determined based on multiple calibration passes compensates for (i.e., essentially zeros out) AC errors.

It should be noted that, in order to illustrate the calibration and printing processes in the above-described embodiments, the sheet transport device 201*a* is referenced as the "first sheet transport device" and the sheet transport device 201*b*, which follows device 201*b* within the path 240, is referenced as the "second sheet transport device". However, in these embodiments, calibration simply requires one of the two sheet transport devices to operate in the constant velocity mode and the other to operate in the constant power mode. Device position within the path is generally not a factor. Thus, alternatively, sheet transport device 201*b* could function as the first sheet transport device and sheet transport device 201*a* could function as the second sheet transport device during calibration and printing.

Also, in addition to the calibration operation (see item 100 of FIG. 1 or item 300 of FIG. 3) and printing operation (see item 150 of FIGS. 1 and 350 of FIG. 3), the above-described embodiments can further comprise a recalibration operation 175, 375 performed in the same manner as the calibration operation 100, 300. Recalibration 175, 375 can be initiated, for example, automatically after a predetermined amount of time, automatically after a predetermined number of printing operations, automatically in response to detected registration or image on image transfer errors and/or on demand.

Figure 8:
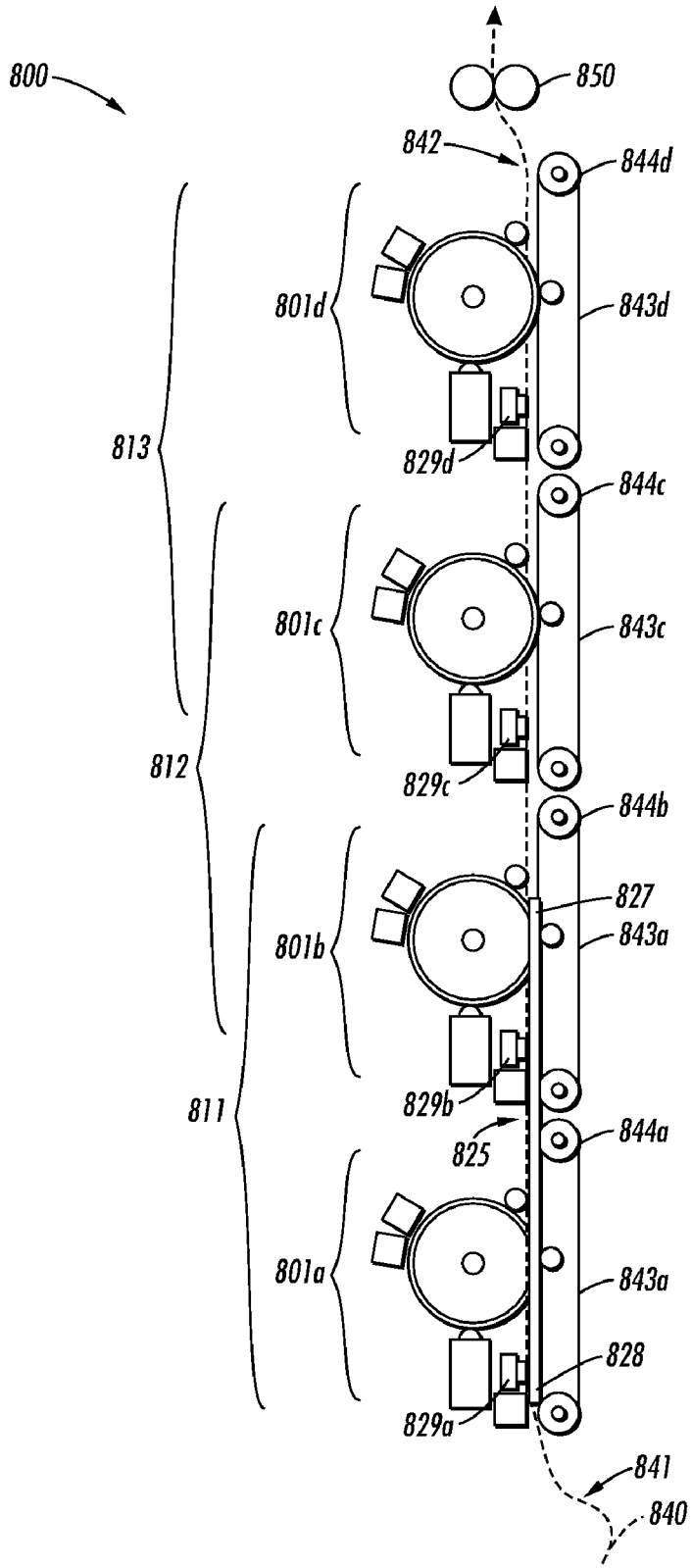
FIG. 8 is a schematic diagram illustrating an exemplary printing device.

In another embodiment, the method takes into account a situation, as shown in FIG. 8 below, where the printing device 800 comprises three or more adjacent sheet transport devices (e.g., 801*a-d*) within the sheet transport path 840 and where the sheet transport devices 801*a-d* are positioned in series such that a sheet 825 moving through the path 840 may be transported by two of the sheet transport devices (e.g., 801*a* and 801*b* (as illustrated), 801*b* and 801*c*, and so on) at a time. Specifically, in the printing device 800, the pairs 811-813 of transport devices sequentially overlap such that they all contain a transport device from at least one immediately adjacent pair. For example, if sheet transport devices 801*a*, 801*b*, 801*c* and 801*d* are positioned in series along the path 840, as illustrated, then the pair 811 would comprise devices 801*a* and 801*b*, the pair 812 would comprise devices 801*b* and 801*c* and the pair 813 would comprise devices 801*c* and 801*d*.

Figure 4:
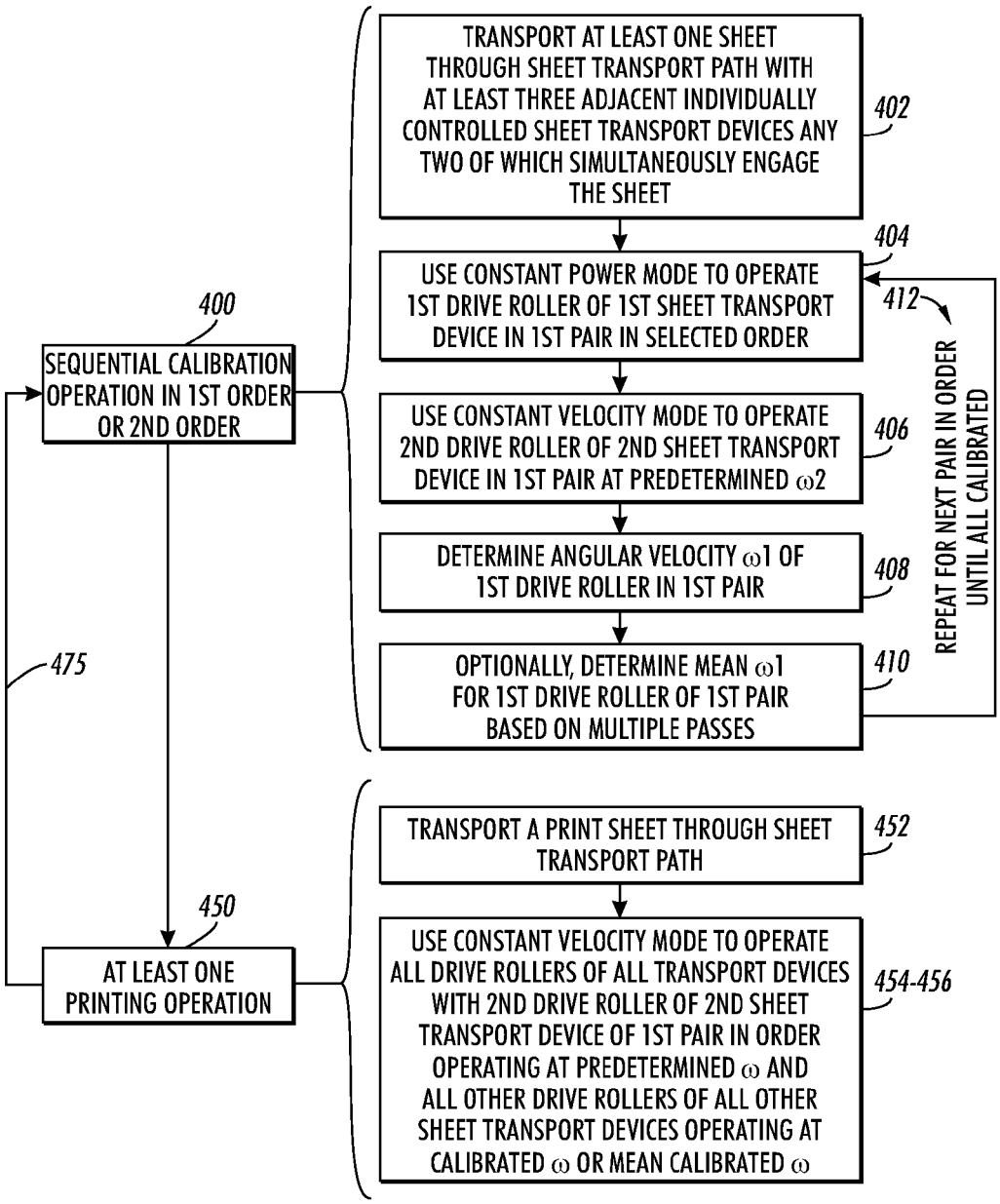
FIG. 4 is a flow diagram illustrating a method embodiment.

Referring to the flow diagram of FIG. 4 in combination with FIG. 8, this embodiment comprises performing a sequential calibration operation 400 for at least three adjacent sheet transport devices (e.g., 801*a-d*) within a sheet transport path 840 of a printing device 800 and also performing at least one printing operation 450 using the printing device 800.

The sequential calibration operation (400) comprises transporting at least one test sheet 825 along the path (402). Then, each pair 811, 812, 813 of the adjacent transport devices 801*a-d* in the path 840 is separately and sequentially calibrated, in either a first order beginning from the end 842 of the path 840 (e.g., from pair 813 to pair 811) or a second order beginning from the start 841 of the path 840 (e.g., from pair 811 to pair 813) (412).

For illustration purposes, the calibration process of this embodiment is described below as being performed in the first order (i.e., beginning from the end 842 of the path 840). Specifically, during calibration, when a test sheet 825 is transported by a first sheet transport device 801*c* and by a second sheet transport device 801*d* that is adjacent to the first sheet transport device 801*c* in the first pair 813 in the first order (e.g., as determined by sheet position sensors 829*a-d*) (i.e., when the sheet is simultaneously engaged by or acted upon by both transport devices in the pair 813 in order to move it towards the end 842 of the path 840), then a constant power mode is used to rotate the first drive roller 844*c* of the first sheet transport device 801*c* in that pair 813 (404). Additionally, a constant velocity mode is used to rotate a second drive roller 844*d* of the second sheet transport device 801*d* in that pair 813 at a predetermined angular velocity $\omega_2$ (406). This predetermined angular velocity $\omega_2$, at which the second drive roller 844*d* of the second sheet transport device in pair 801*d* is set, is determined prior to the calibration operation (e.g., by a user or by default based on a desired sheet velocity).

Mode adjustment can be accomplished through the use of a conventional controller or electronic control subsystem (ESS) (e.g., as discussed in U.S. Pat. No. 7,457,557 incorporated by reference above), which preferably comprises a programmable, self-contained, dedicated mini-computer having a central processor unit (CPU), electronic storage, etc., which is located onboard the printing device 800 and which functions as the main control system for the components and other subsystems of printing device 800, including the control system for any discrete servomechanisms for independently driving the various sheet transport devices. As a function of these different modes, the second sheet transport device 801*d* in the pair 813 alone controls the linear velocity v of the sheet 825 and drive roller contention does not occur.

Then, as the first drive roller 844*c* in the pair 813 is rotated, its actual angular velocity $\omega_2$ is determined (408). Angular velocity is determined using conventional processing techniques. For example, each drive roller 844*a-d* can be configured with a motion encoder (not shown), which produces an electronic signal whose frequency is proportional to the angular velocity of the roller being measured. Optionally, rather than determining the angular velocity $\omega_2$ based on one calibration pass, multiple calibration passes can be performed and a mean angular velocity (mean $\omega_2$) for the first drive roller of each pair can be determined (410). The determined angular velocity $\omega_2$ (or determined mean $\omega_2$) can subsequently be used during the printing operation to compensate for drive contention.

This process is then repeated for each pair from pair 813 to pair 811 (412). As mentioned above, during calibration of the first pair 813 in the first order, the predetermined angular velocity $\omega_1$, at which the second drive roller 844*d* of the second sheet transport device 801*d* is set, is determined prior to the calibration operation (e.g., by a user or by default based on a desired sheet velocity). Also, as mentioned above, the pairs 811-813 sequentially overlap such that they all contain a transport device from at least one immediately adjacent pair (i.e., 801*a*-801*b*, 801*b*-801*c*, etc.). Thus, with each subsequently calibrated pair, the second sheet transport device with the second drive roller is actually the first sheet transport device with the first drive roller from an immediately adjacent and previously calibrated pair and the predetermined angular velocity that should be used for the second drive roller is the previously calibrated angular velocity (i.e., is that angular velocity $\omega_1$ determined for the first drive roller during calibration of the immediately adjacent and previously calibrated pair). For example, when calibrating in the first order, the drive roller 844*c* of sheet transport device 801*c* is both the first drive roller of the first sheet transport device of the first pair 813 and the second drive roller of the second device of the pair 812. Consequently, when calibrating the next pair 812 in the first order, the predetermined angular velocity $\omega_2$ at which the second drive roller 844*c* is rotated at process 406 is the angular velocity $\omega_1$, as previously determined for the drive roller 844*c* during calibration of the pair 813 (i.e., is that angular velocity $\omega_1$ determined for the first drive roller during calibration of the immediately adjacent and previously calibrated pair).

It should be noted the relative position of the "first sheet transport device" and the "second sheet transport device" in each pair within the path for purposes of performing the calibration operation varies depending upon whether the calibration operation is being performed in the first order or in the second order. Specifically, when the calibration operation is performed in the first order (i.e., beginning from the end 842 of the path 840), then the second sheet transport device of each pair follows the first sheet transport device within the path 840. Contrarily, when the calibration operation is performed in the second order (i.e., beginning from the start 841 of the path 842), then the second sheet transport device of each pair precedes the first sheet transport device within the path.

Thus, during calibration of the pairs of adjacent sheet transport device in the second order (i.e., beginning at the start 841 of the path 840 from pair 811 to pair 813), when a test sheet 825 is transported by a first sheet transport device 801*b* and by a second sheet transport device 801*a* that is adjacent to the first sheet transport device 801*b* in the first pair 811 in the second order, then a constant power mode is used to rotate the first drive roller 844*b* of the first sheet transport device 801*b* in that pair 811 (404). Additionally, a constant velocity mode is used to rotate a second drive roller 844*a* of the second sheet transport device 801*a* in the pair 811 at a predetermined angular velocity $\omega_2$ (406). This predetermined angular velocity $\omega_2$ at which the second drive roller 844*a* of the second sheet transport device in pair 801*a* is set, is determined prior to the calibration operation (e.g., by a user or by default based on a desired sheet velocity). Then, this process is repeated for each pair from pair 811 to pair 813 (412) such that with each subsequently calibrated pair, the second sheet transport device with the second drive roller is actually the first sheet transport device with the first drive roller from an immediately adjacent and previously calibrated pair and the predetermined angular velocity that should be used for the second drive roller is the previously calibrated angular velocity (i.e., is that angular velocity $\omega_1$ determined for the first drive roller during calibration of the immediately adjacent and previously calibrated pair).

For example, in the second order, the drive roller 844*b* of sheet transport device 801*b* is both the first drive roller of the first sheet transport device of the first pair 811 and the second drive roller of the second sheet transport device of the pair 812. Consequently, when calibrating the pair 812 in the second order, the predetermined angular velocity $\omega_2$ at which the second drive roller 844*b* is rotated at process 406 is the angular velocity $\omega_1$, as previously determined for the drive roller 844*b* during calibration of the pair 811 (i.e., is that angular velocity $\omega_1$ determined for the first drive roller during calibration of the immediately adjacent and previously calibrated pair).

Once the calibration operation is completed, one or more printing operations can be performed (450). Each printing operation comprises transporting a print sheet 825 along the path (452). When the print sheet is transported by the sheet transport devices in the adjacent pairs (e.g., by devices 801*a* and 801*b* of pair 811, 801*b* and 801*c* of pair 812 and 801*c* and 801*d* of pair 813) (e.g., as determined by sheet position sensors 829*a-d*), then the constant velocity mode is used to rotate the first drive roller of the first sheet transport device in a given pair at the angular velocity $\omega_1$ (or mean $\omega_1$) that was determined for that first drive roller during the calibration operation (454). Additionally, the constant velocity mode is again used to rotate the second drive roller of the second sheet transport device in that pair at the predetermined angular velocity $\omega_2$ (456). In other words, during the printing operation, the constant velocity mode is used to operate all drive rollers of all sheet transport devices and, specifically, the drive roller of the sheet transport device at the end of the path (e.g., when calibration occurred in the first order) or at the start of the path (e.g., when calibration occurred in the second order) is set at an initial predetermined $\omega$ and all other drive rollers are set at a calibrated or mean calibrated $\omega$.

As a result of the calibration operation, drive contention is compensated for and the linear velocity v from the leading edge 827 of each sheet 825 to the trailing edge 828 of each sheet 825 will remain essentially constant during the printing operation across adjacent sheet transport devices. Furthermore, as discussed above, using the mean angular velocity (mean $\omega_1$) determined based on multiple calibration passes will compensate (i.e., essentially zero out) AC errors.

Also, in addition to the calibration and printing operations (see items 400 and 450 of FIG. 4), the above-described embodiment can further comprise a recalibration operation 475 performed in the same manner as the calibration operation 400. Recalibration 475 can be initiated, for example, automatically after a predetermined amount of time, automatically after a predetermined number of printing operations, automatically in response to detected registration or image on image transfer errors and/or on demand.

Figure 5:
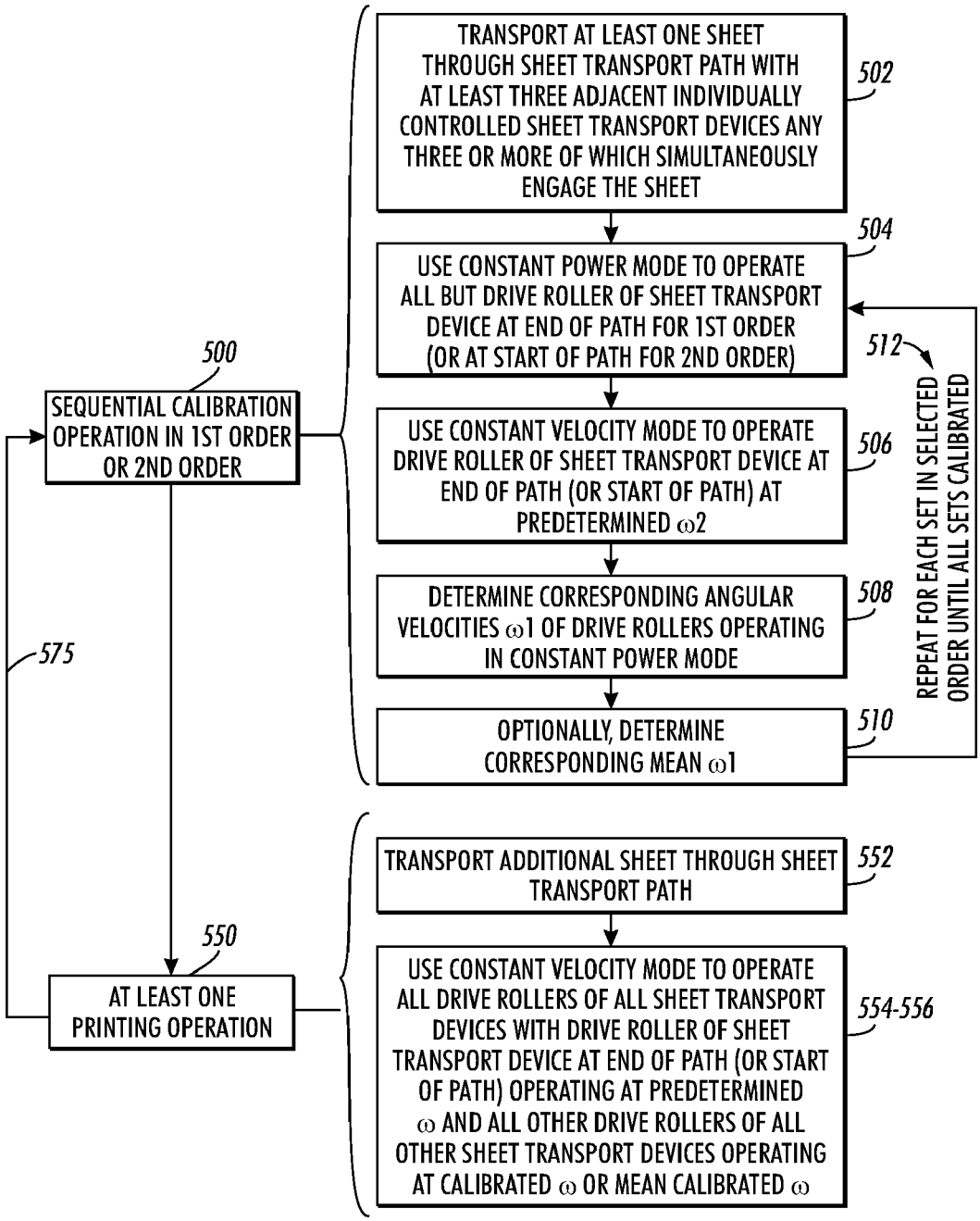
FIG. 5 is a flow diagram illustrating a method embodiment.
Figure 6:
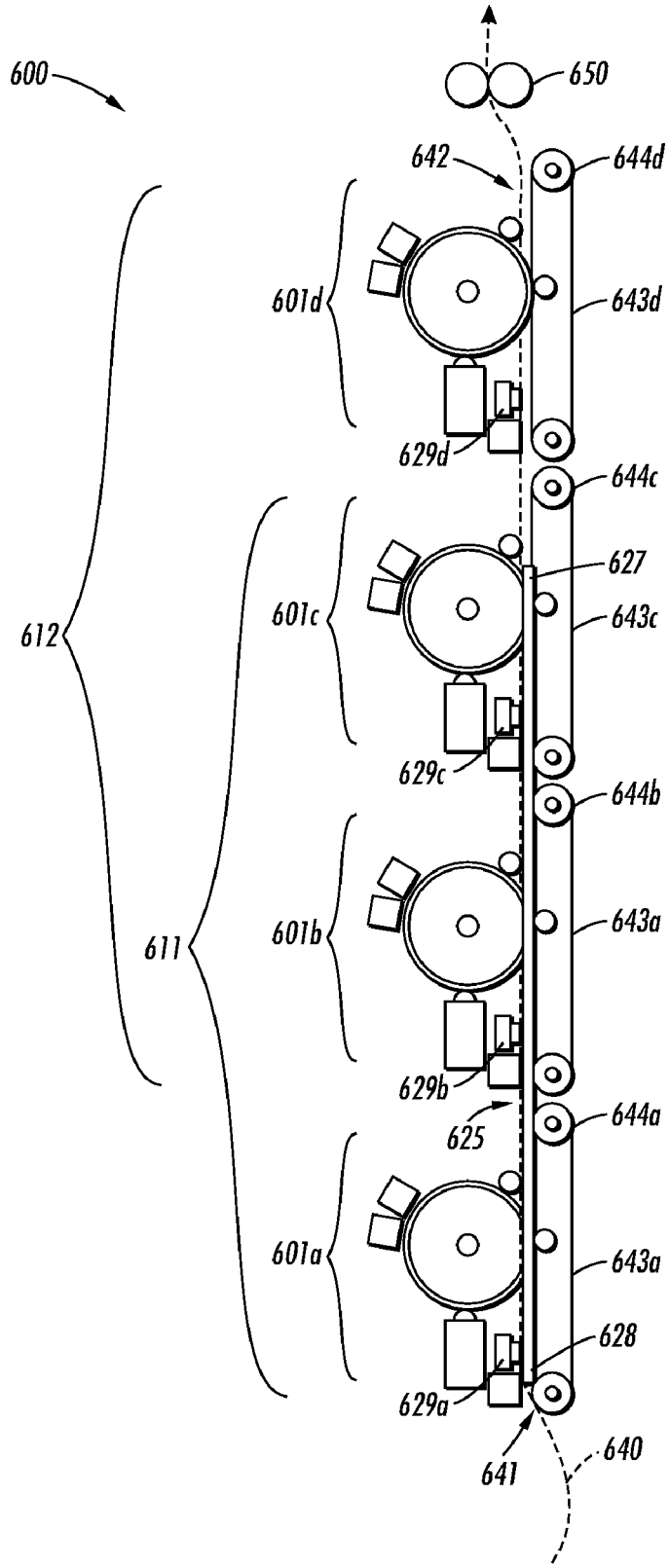
FIG. 6 is a schematic diagram illustrating an exemplary printing device.

Referring to flow diagram of FIG. 5 in combination with FIG. 6, another embodiment of the method takes into account a situation where a printing device 600 comprises three or more adjacent sheet transport devices 601*a-d* within a sheet transport path 640 and where the sheet transport devices 601*a-d* are positioned in series such that a sheet 625 moving along the path 640 may be transported by a set (e.g., 611 or 612) of three or more of the sheet transport devices. That is, this embodiment considers a situation where more than two sheet transport devices simultaneously engage a single sheet.

Specifically, in the printing device 600, the sets 611-612 of sheet transport devices sequentially overlap such that they all contain sheet transport devices from at least one immediately adjacent set. For example, if sheet transport devices 601*a-d* are positioned in series along the path 640, then set 611 could, for example, comprise devices 601*a-c* and set 612 could comprise devices 601*b-d*. As with the previously described embodiments, this embodiment comprises performing a sequential calibration operation for the adjacent sheet transport devices 601*a-d* within a sheet transport path 640 of a printing device 600 and also performing at least one printing operation using the printing device 600.

The calibration operation (500) comprises transporting at least one test sheet 625 along the path 640 (502). Then, each set of the adjacent sheet transport devices, which will simultaneously engage the test sheet 625 being transported along the sheet transport path 640, is separately and sequentially calibrated, in either a first order beginning from the end 642 of the path (i.e., from set 612 to set 611) or a second order beginning from the start 641 of the path 640 (i.e., from set 611 to set 612).

For illustration purposes, this method embodiment is described below using a calibration process performed according to the first order. Specifically, during calibration, when a test sheet 625 is simultaneously engaged by all sheet transport devices in set 612 (i.e., when the sheet is simultaneously engaged by or acted upon by all transport devices in set 612 in order to move it towards the end 642 of the path 640), a constant velocity mode is used to rotate a single drive roller (e.g., 644*d*) of a single transport device (e.g., 601*d*) in the set 612 at a predetermined angular velocity $\omega_2$ (506). The predetermined angular velocity, at which the drive roller 644*d* of sheet transport device 601*d* in set 612 is set, is determined prior to the calibration operation (e.g., by a user or by default based on a desired sheet velocity). Additionally, a constant power mode is used to rotate any other drive rollers (e.g., 644*c* and 644*b*) of any other transport devices (e.g., 601*b-c*) in the set 612 (504).

Mode adjustment can be accomplished through the use of a conventional controller or electronic control subsystem (ESS) (e.g., as discussed in U.S. Pat. No. 7,457,557 incorporated by reference above), which preferably comprises a programmable, self-contained, dedicated mini-computer having a central processor unit (CPU), electronic storage, etc., which is located onboard the printing device 600 and which functions as the main control system for the components and other subsystems of printing device 600, including the control system for any discrete servomechanisms for independently driving the various sheet transport devices. As a function of these different modes, the single transport device (e.g., 601*d*) in a given set (e.g., 612) alone controls the linear velocity v of the sheet 625 and drive roller contention does not occur.

Then, as the other drive rollers 644*b-c* in the set 612 are rotated, their corresponding angular velocities $\omega_1$ are determined (508). Angular velocity $\omega_1$ can be determined using conventional processing techniques. For example, each drive roller 644*a-d* can be configured with a motion encoder (not shown), which produces an electronic signal whose frequency is proportional to the angular velocity of the roller being measured. Optionally, rather than determining the corresponding angular velocities $\omega_1$ based on one calibration pass, multiple calibration passes can be performed and corresponding mean angular velocities (mean $\omega_1$) for these other drive rollers within each set can be determined (510).

This process is repeated for each set in the selected order (i.e., for set 611 in the first order). As mentioned above, the sets of transport devices sequentially overlap such that they all contain transport devices from at least one immediately adjacent set (i.e., set 611 contains devices 601*a-c*, set 612 contains devices 601*b-d*, etc.). Thus, with each subsequently calibrated set, the predetermined angular velocity that should be used for the single drive roller is determined during calibration of the immediately adjacent and previously calibrated set. For example, the drive roller 644*c* of the sheet transport device 601*c* is operated in the constant power mode when calibrating set 612, but operated in the constant velocity mode when subsequently calibrating set 611. Thus, when calibrating the set 611, the predetermined angular velocity $\omega_2$ at which the drive roller 644*c* is rotated at process 506 is the angular velocity $\omega_1$, as previously determined for drive roller 644*c* during calibration of set 612.

As mentioned above, the sequential calibration process of this embodiment was described above, for purposes of illustration, as being performed according to a first order beginning from the end 642 of the path 640 (e.g., from set 612 to set 611). It should be noted, however, that the relative position of the "single transport device" and the "any other transport devices" within the path for purposes of performing the calibration operation varies depending upon whether the calibration operation is being perform in the first order or in the second order. Specifically, when the calibration operation is performed in the first order the single transport device follows, within the path, any other transport devices of a set. Contrarily, when the calibration operation is performed in the second order the single transport device precedes, within the path, any other transport devices of a set.

Once the calibration operation is completed, one or more printing operations can be performed (550). Each printing operation comprises transporting a print sheet 625 along the path 640 (552). When the print sheet is being transported by the sheet transport devices in the adjacent sets (e.g., by devices 601*a-c* of set 611 and 601*b-d* of set 612), the constant velocity mode is used to rotate the single drive roller (e.g., 644*d*) of the single transport device (e.g., 601*d*) in a given set at the predetermined angular velocity $\omega_2$ (556). Additionally, the constant velocity mode is used to rotate any other drive rollers (e.g., 644*a-c*) from any other sheet transport devices (e.g., 601*a-c*) in that given set at their corresponding angular velocity $\omega_1$ (or mean $\omega_1$) as determined during the calibration operation (554). In other words, the constant velocity mode is used to operate all drive rollers of all sheet transport devices and, specifically, the drive roller of the sheet transport device at the end of the path (e.g., when calibration occurred in the first order) or at the start of the path (e.g., when calibration occurred in the second order) is set at an initial predetermined $\omega$ and all other drive rollers are set at a calibrated or mean calibrated $\omega$. As a result of the calibration operation, the linear velocity v from the leading edge 627 of each sheet 625 to the trailing edge 628 of each sheet 625 will remain essentially constant during the printing operation. Furthermore, as discussed above, using corresponding mean angular velocities determined based on multiple calibration passes will compensate for (i.e., essentially zero out) AC errors.

It should be understood that in the above-described method embodiments, the terms "constant power mode" (i.e., the torque assist mode) and "constant velocity mode" encompass different modes by which actuators (e.g., servo drivers of servomechanisms) control the motors (e.g., servo motors) for the drive rollers and, thereby control the drive rollers of the different sheet transport devices. For example, in the constant power mode a constant level of power is supplied to a specified motor of a specified drive roller in order to approximately achieve a pre-set angular velocity. Alternatively, in the constant velocity mode an actual angular velocity of a specified drive roller is continuously or periodically determined and, based on the actual angular velocity, the level of power supplied to the specified motor of the specified drive roller is adjusted in order to maintain the specified driver roller at a pre-set angular velocity. This same encoder can be used during the constant velocity mode as a part of the feedback mechanism used to monitor and adjust the drive roller's velocity.

Additionally, it should be understood that the term "printing device" as used herein encompasses any of a digital copier, bookmaking machine, facsimile machine, multi-function machine, etc. which performs a print outputting function for any purpose. The term "printing device" further refers to either direct to paper printing devices or printing devices that incorporate one or more intermediate transfer belts. The term "printing device" further refers to either single or multi-color printing devices. The details of printing devices (e.g., printers, printing engines, etc.) are well-known by those ordinarily skilled in the art. Printing devices are readily available devices produced by manufactures such as Xerox Corporation, Norwalk, Conn., USA. Such printing devices commonly include input/output, power supplies, processors, media movement devices, marking devices etc., the details of which are omitted herefrom to allow the reader to focus on the salient aspects of the embodiments described herein.

It should further be understood that term "individually driven sheet transport device" as used herein encompasses any of an electrostatic transport belt, nip apparatus, registration system, fuser system, feeder system, etc., having a drive roller controlled by, for example, a servo-mechanism and configured in conjunction with other components (e.g., an electrostatic belt, idle roller, etc.) to engage (e.g., electrostatically, mechanically between the drive roller and another roller, etc.) and propel a sheet forward along a sheet transport path within the printing device. The term "sheet" as used herein encompasses any cut sheet of print media substrate suitable for receiving images, such as, a sheet of paper, plastic, vinyl, etc.

Figure 7:
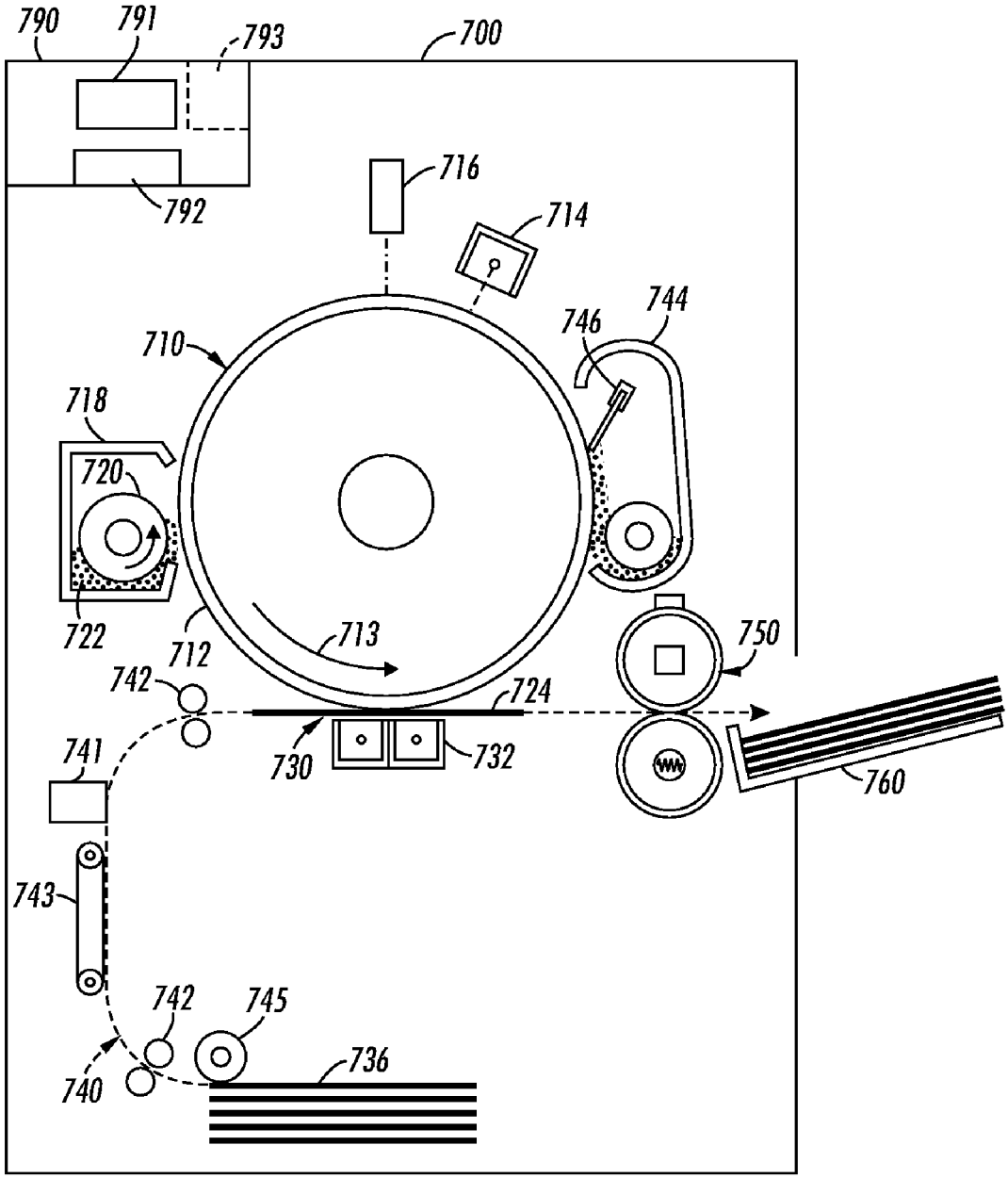
FIG. 7 is a schematic diagram illustrating an exemplary printing device.

FIG. 7 is an illustration of a simplified view of single color direct to paper printing device for which the method embodiments disclosed herein can be employed. A similar printing device to that of FIG. 7 was previously disclosed and discussed in detail, in U.S. Pat. No. 7,457,557 issued on Nov. 25, 2008, the complete disclosure of which is fully incorporated herein by reference.

FIG. 7 shows the relevant elements of a single color electrostatographic printing device 700. As is well known, a charge receptor or photoreceptor 710 having an imagable surface 712 and rotatable in a direction 713 is uniformly charged by a charging device 714 and image-wise exposed by an exposure device 716 to form an electrostatic latent image on the surface 712. The latent image is thereafter developed by a development apparatus 718 that, for example, includes a developer roll 720 for applying a supply of charged toner particles 722 to such latent image. The developer roll 720 may be of any of various designs such as a magnetic brush roll or donor roll, as is familiar in the art. The charged toner particles 722 adhere to appropriately charged areas of the latent image. The surface of photoreceptor 710 then moves, as shown by the arrow 713, to a transfer zone generally indicated as 730.

Simultaneously, a print sheet 724 on which a desired image is to be printed is drawn from a sheet supply stack 736, using a feeder system 745, and conveyed along a sheet path 740 by various sheet transport devices. For example, as the feeder system 745 pulls a print sheet 724 from the sheet stack 736, nip apparatus 742 can guide the sheet to an electrostatic belt transport device 743. The electrostatic belt transport device 743 can transport the sheet 724 to registration system 741. The registration system 741 can register and transport the sheet 724 to another nip apparatus 742, which guides the sheet to the transfer zone 730.

At the transfer zone 730, the print sheet 724 is brought into contact or at least proximity with a surface 712 of photoreceptor 710, which at this point is carrying toner particles thereon. A corotron or other charge source 732 at transfer zone 730 causes the toner image on photoreceptor 710 to be electrostatically transferred to the print sheet 724. The print sheet 724 is then forwarded to subsequent stations, as is familiar in the art, including the fusing apparatus 750 which permanently fixes the image to the sheet 724. From the fusing apparatus 750, the sheet 724 may be transported to a finisher (not shown) and then to an output tray 760. Following such transfer of a toner image from the surface 712 to the print sheet 724, any residual toner particles remaining on the surface 712 are removed by a toner image bearing surface cleaning apparatus 744 including a cleaning blade 746, for example.

Thus, as illustrated and described herein, the printing device 700 of FIG. 7 incorporates multiple sheet transport devices that transport the print sheet 724 along the path 740, including but not limited to feeder system 745, nip apparatuses 742, transport belt 743, and fuser apparatus 750. Each of these sheet transport devices may be independently driven, for example, by discrete servomechanisms. Therefore, each of these sheet transport devices can be calibrated and operated as described above.

As further shown, the reproduction machine 700 includes a controller or electronic control subsystem (ESS), indicated generally by reference numeral 790 which is preferably a programmable, self-contained, dedicated mini-computer having a central processor unit (CPU), electronic storage 791, and a display or user interface (UI) 792. The ESS 790, with the help of sensors, a look up table 793 and connections, can read, capture, prepare and process image data such as pixel counts of toner images being produced and fused. As such, it is the main control system for components and other subsystems of machine 700 including any discrete servomechanisms for independently driving the various sheet transport devices. This main control system can thus be used to control the calibration and operation processes described above.

As mentioned above, the method embodiments disclosed herein can also be employed with multi-color printing devices, which have individually driven sheet transport devices similar to those described above and illustrated in FIG. 7. For example, see the multi-color printing device with the single intermediate transfer belt described in detail in U.S. Patent Application Publication No. 2003/0108369, the complete disclosure of which is incorporated herein by reference. See also the multi-color direct to paper printing device with the multiple color modules described in detail in U.S. Patent Application Publication No. 2006/0222378, the complete disclosure of which is incorporated herein by reference. See also FIG. 8, which illustrates another multi-color direct to paper printing device having multiple color modules.

Specifically, in the device of FIG. 8, a sheet 825 travels along a sheet transport path 840 between multiple marking modules in series. As illustrated, FIG. 8 shows four marking modules 801*a*, 801*b*, 801*c* and 801*d*; however, it is anticipated that the device of FIG. 8 may incorporate less than four marking modules (e.g., two or three marking modules) or more than four marking modules (e.g., five, six, etc.). Within each module an image is printed on the sheet 825, as discussed above with regard to FIG. 7. After passing through the multiple modules, the sheet 825 passes through a fuser 850 so that the final image (i.e., the combined image from the multiple marking modules) can be permanently fixed to the sheet 825. Each module includes a corresponding electrostatic transport belt (e.g., see belts 843*a-d*), which engages the sheet electrostatically and propels the sheet through its module and onto the next module. Each belt is driven by a discrete drive roller (e.g., see drive rollers 844*a-d*). Each drive roller is rotated by a motor (not shown) that is independently controlled by an actuator (e.g., a servomechanism). As the drive roller for the corresponding belt rotates at an angular velocity ω, it moves the belt and, thereby the sheet 825 at a linear velocity v.

As mentioned above, with such independently driven sheet transport devices, velocity matching becomes critical in order to avoid errors (e.g., registration errors, image on image transfer errors, etc.), particularly when a transported sheet spans across and is simultaneously engaged by multiple sheet transport devices. For example, referring to FIG. 8, consider a sheet 825 being transported along a path 840 between a preceding sheet transport device 801*b* and a following sheet transport device 801*c*. When the servomechanisms of the sheet transport devices 801*b* and 801*c* are in contention, the leading edge 827 of the sheet 825, as it passes a point 828 along the path, will have a certain velocity (e.g., as detected by sheet position sensor 829). When the sheet 825 is finally output from the preceding sheet transport device 801*b* such that the servomechanisms of the two sheet transport devices 801*b* and 801*c* are no longer in contention, the velocity of the sheet 825 will momentarily spike due to servo positional error (i.e., will register a sharp increase or decrease) relative to that of the leading edge 827 when it passed the previous point 828. Such velocity variations can result in the same errors that the servomechanisms were designed to avoid (e.g., registration errors, image on image transfer errors, etc.). The calibration and printing operations discussed in the embodiments disclosed above can be used to avoid such contention and thereby can avoid sheet velocity variations which cause registration errors and/or image on image transfer errors.

Also disclosed herein are embodiments of a computer program product comprising a computer usable medium having computer useable program code embodied therewith. This computer usable program code can be configured to perform the above described method embodiments. More specifically, the embodiments can take the form of a computer program product accessible from a computer-usable or computer-readable medium, providing program code for use by or in connection with a computer or any instruction execution system. For example, the computer program product can be executed on a controller or electronic control subsystem (ESS) of a printing device. The controller or electronic control subsystem can preferably comprise a programmable, self-contained, dedicated mini-computer having a central processor unit (CPU), electronic storage, and a display or user interface (UI) and can function as the main control system for components and other subsystems of the printing device including any discrete servomechanisms for independently driving the various sheet transport devices.

For the purposes of this description, a computer-usable or computer readable medium can be any apparatus that can comprise, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output (I/O) devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

Therefore, disclosed above are embodiments of a method that incorporates calibration and printing operations to be used with a printing device. The printing device contains a sheet transport path with multiple adjacent sheet transport devices (e.g., electrostatic sheet transport belts, nip roller apparatuses, registration systems, fusers, etc.), each having at least one independently controlled drive roller. Each preceding sheet transport device feeds a sheet to a following sheet transport device along the path in succession. Furthermore, two or more adjacent sheet transport devices are positioned to simultaneously engage the sheet as it is being transported along the path. The calibration operation is used to determine the particular drive roller angular velocity that should be used by each sheet transport device to compensate for drive roller contention during the printing operation and, thereby to ensure that the linear velocity of the sheet essentially remains constant as it is transported across each adjacent transport throughout the printing operation.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

What is claimed is:

1. A method comprising:

performing a calibration operation for adjacent sheet transport devices within a sheet transport path of a printing device, said performing of said calibration operation comprising:

transporting a test sheet along said path;

when said test sheet is simultaneously transported by both a first transport device and a second transport device adjacent to said first transport device in said path, using a constant power mode to operate said first transport device and further using a constant velocity mode to operate said second transport device at a predetermined velocity; and during said constant power mode operation of said first transport device, determining a calibration velocity of said first transport device; and performing at least one printing operation using said printing device, said printing operation comprising:

transporting a print sheet along said path; and when said print sheet is simultaneously transported by both said first transport device and said second transport device, using said constant velocity mode to operate said first transport device at said calibration velocity, as determined during said calibration operation, and further using said constant velocity mode to operate said second transport device at said predetermined velocity.

2. The method of claim 1, said performing of said calibration operation further comprising:

when said test sheet is transported by both said first transport device and said second transport device, using said constant power mode to rotate a first drive roller of said first transport device and further using said constant velocity mode to rotate a second drive roller of said second transport device at a predetermined angular velocity; and during rotation of said first drive roller, determining an angular velocity of said first drive roller; and said performing of said printing operation further comprising, when said print sheet is simultaneously transported by both said first transport device and said second transport device, using said constant velocity mode to rotate said first drive roller at said angular velocity, as determined during said calibration operation, and further using said constant velocity mode to rotate said second drive roller at said predetermined angular velocity.

3. The method of claim 1, said constant power mode comprising supplying a constant level of power to a specified motor of a specified drive roller in order to approximately achieve a pre-set angular velocity.

4. The method of claim 1, said constant velocity mode comprising:

determining an actual angular velocity of a specified drive roller; and adjusting a level of power supplied to a specified motor of said specified drive roller in order to maintain said specified driver roller at a pre-set angular velocity.

5. The method of claim 1, said adjacent sheet transport devices comprising any of electrostatic sheet transport belts, nip roller apparatuses, registration systems, and fusers.

* * * * *